US005238307A

United States Patent [19]

Mooney et al.

[11] Patent Number: 5,238,307

[45] Date of Patent: Aug. 24, 1993

[54] ORE SAMPLE BAG

[75] Inventors: Kurtis E. Mooney; Ronald M. Rogers, both of Salt Lake City, Utah

[73] Assignee: Tri-Combined Resources, Inc., Salt Lake City, Utah

[21] Appl. No.: 826,986

[22] Filed: Jan. 28, 1992

[51] Int. Cl.[5] ..... B65D 30/04; B65D 33/28

[52] U.S. Cl. ..... 383/74; 40/631; 206/459.5; 112/265.1; 112/262.2; 383/107; 383/127

[58] Field of Search ..... 383/107, 108, 127, 74, 383/75, 79; 40/631; 493/375, 210, 186; 53/415, 137.2, 135.3; 112/262.2, 265.1; 206/459.5

[56] References Cited

U.S. PATENT DOCUMENTS

| | | | |
|---|---|---|---|
| 529,690 | 11/1894 | Arkell et al. | 383/107 |
| 723,282 | 3/1903 | Jessen et al. | 383/107 |
| 1,907,393 | 5/1933 | Tooley | 40/631 |
| 1,944,613 | 1/1934 | Rowe | 383/107 |
| 2,028,714 | 1/1936 | Burwick | 383/74 |
| 2,059,096 | 10/1936 | Goodchild | 40/631 |
| 2,103,092 | 12/1937 | Robinson | 112/262.2 |
| 2,437,184 | 3/1948 | Brady et al. | 206/459.5 |
| 2,588,695 | 3/1952 | Brady et al. | 383/107 |
| 2,659,520 | 11/1953 | Reitzes | 493/375 |
| 2,705,517 | 4/1955 | Elsas | 206/459.5 |
| 2,815,899 | 12/1957 | Swanson | 206/459.5 |
| 2,939,501 | 6/1960 | Corman et al. | 383/107 |
| 2,980,313 | 4/1961 | Quinn | 383/107 |
| 4,988,216 | 1/1991 | Lyman | 383/74 |
| 5,078,508 | 1/1992 | Johan et al. | 383/75 |

*Primary Examiner*—Stephen P. Garbe
*Attorney, Agent, or Firm*—Madson & Metcalf

[57] ABSTRACT

A bag for handling ore samples constructed from a flexible semipermeable sheet material folded to have a top opening, an obverse side, a reverse side, and at least one folded seam. The folded seam comprises an edge of the obverse side and an edge of the reverse side folded together and secured along a path adjacent to the fold. The bag may have a wrap around label disposed over and secured to the folded seam such that a front portion of the label is disposed adjacent the obverse side of the bag and a back portion of the label is disposed adjacent the reverse side of the bag. The label bears indicia on the front portion and on the back portion wherein the indicia on the front portion is machine readable bar code and human readable indicia and the indicia on the back portion is human readable and corresponds to the indicia on the front portion. One embodiment of the bag has a secured lock top which can be interchangeably opened and closed by manipulation of a configuration of the top portion of the bag. Another embodiment of the bag allows interchangeable opening and closing of the bag by utilizing a drawstring and slide-spring lock mechanism.

8 Claims, 4 Drawing Sheets

ORE SAMPLE BAG

FIELD OF THE INVENTION

The present invention relates to an apparatus used for retaining ore samples gathered to be assayed, and more particularly to an improved ore sample bag that can be used as an exploration sample bag or a mine sample bag and can be readily tracked during collection, transportation, preparation, and assay.

BACKGROUND OF THE INVENTION

In mining operations, it is necessary to monitor what is being mined to determine the grade of ore. Mining costs are expensive. If the grade of ore is not high enough to justify the mining expense, the mine may be shut down until less expensive methods for mining can be discovered or new mining sites are found. Having mining operations follow the high grade ore deposits is imperative. To do this, representative samples of the ore being mined must be assayed. Since assay facilities are typically not located at the mining site, the ore samples must be collected, transported to the assay facility, and prepared for assay.

Likewise, exploration for metals and minerals requires the monitoring of ore samples. However, the collection and transportation of exploration samples create problems that can be significantly different from the problems encountered with the collection and transportation of mine samples. For example, exploration samples may result from a drilling process known as "reverse circulation" drilling which is deep drilling where water is used to bring the sample to the surface. With this process, samples have been collected every five feet in plastic buckets and transferred as a slurry to clear plastic bags and sealed using a wire tie and labeled with a marking pen and a paper tag. Typically, the samples have been left standing in the field until the liquid and solids separated. The bag was then pierced above the solids layer to drain the standing water out onto the ground. Fine particles were often poured onto the ground.

The collection of mine samples presents different requirements and needs. Mine samples are collected at the blast hole drills. Surveyors lay out each row of drilling and assign sample numbers to each of the holes to be drilled Typically, the driller places a sample bag in a 4" diameter PVC pipe which is part of a sample catcher. The catcher is lowered through the drill deck prior to drilling and is raised before any sub-drilling is required. The sample is recovered and tossed off the platform to be collected by the sampler and the drill is advanced to the next hole.

The mine sample is collected using a relatively dry process compared to reverse circulation drilling. Thus, the bag does not need to be a filter media for separation of the sample from the water. However, the blast hole cuttings can be larger and sharper than the exploration cuttings and the volume of cuttings required for assay is less.

In the past, the collection, transportation, and preparation of ore samples have been done in cotton "sand bags." These types of bags have had problems in maintaining sample integrity. Leakage of fine particles in the ore sample through the seam of the bag or through the pores in the material from which the bag was constructed have presented particular problems. Later, permeable olefin bags were tested. The permeable olefin bags would automatically drain through the pores in the bag and could be air dried in the field. However, use of these bags raised concerns that losses of fine sample material through the pores would bias the assay. During preliminary testing of such bags, it has been determined that a significant percent of the sample material can be lost when a slurry is allowed to drain from the bag. The material loss has been primarily through the seam of the bag. In one instance, the material lost contained over fifty percent (50%) of the gold, thus significantly downgrading the assay of the sample remaining in the bag.

Plastic bags have also been used, but they were found unsuitable for most uses. Because most plastic bags have a tacky surface, a relatively high sample loss through fines sticky to the bag has been experienced.

In order to address several of the problems with ore sample bags, various improvements have been made. Seams for the bags are folded or lapped before sewing to eliminate leakage through the seam. Also, bags with draw strings have been developed. Additionally, bags constructed of various materials have been used.

A degree of porosity is desirable to allow for drying, but the mesh size of the pores in the bag must be sufficient to restrict passage therethrough by fine particles of the sample. Materials from which ore sample bags are constructed must also be flexible and durable. Materials that have been found to be suitable include a material made by DuPont and sold as Tyvek ® and a canvas-like bone velour material ranging from 270 to 400 mesh.

Equally important in the use of ore sample bags is the need to identify and track the ore sample during the entire process of collection, transportation, preparation, and the assay. Identification and tracking can be a very involved. During exploration, for example, as many as a thousand samples a day may be taken on a predetermined grid pattern. In the past, each sample was identified manually by marking each bag using a pen and label and tracked by manually logging each sample as it passed through each step in the process. However, such identification and tracking is labor intensive and subject to human error, frequently resulting in confusion of samples. Today, it is quite common for a three label technique to be used to increase tracking integrity. With this technique, one label bearing identification indicia is placed on a stake driven into the ground at the location where the sample is taken. A second label is attached to the outside of the bag, and a third label is placed inside the bag. The redundancy is needed to assure identification and tracking capability if one or more of the labels are destroyed during collection, transportation, preparation, or the assay.

As computer technology made bar code reading more feasible, labels with bar codes were attached to the bags. A corresponding human readable identification was written on each bag. However, various problems have been encountered in using bar code labels on ore sample bags. Solvents used in drilling attacked the bar code labels causing significant errors in the logging of samples. Also, writing of human readable identification on each bag was time consuming and subject to human error. Unfortunately, the hand-written identification could be obliterated during the typical rough handling of the ore sample bag.

In order to solve some of the problems with bar coded labels various improvements were introduced. The bar coded labels were preplanned with computer generated tracking indicia. The bar codes were photo composed on polyester stock and a special UV resistant over laminate has been applied. This made the labels one hundred percent scannable, eliminated redundancy and missing numbers, and made the labels resistant to the solvents used during drilling. To again reduce labor costs, bar coded labels are now sewn into the seam of the bag when the bag is constructed, which eliminates the application of the label to the bag in the field. However, heretofore, if a bag was handled roughly such that the tag was torn from the bag and the hand-written indicia was obscured, the bag could not be identified or tracked properly.

Despite all of the efforts to improve ore sample bags to reduce labor costs, reduce ore sample loss, and to assure accuracy in identification and tracking, several problems remain. When bags with drawstrings are tied off in the field, they are frequently difficult to open without cutting the drawstring. If the drawstring is cut, the bag cannot be reclosed without introducing some other means of closure. Additionally, bags closed by gathering the material at the top of the bag such as by drawstring, tying off the bag, or the use of wire ties cause the bag to bunch and not lay as flat as the bag would if the top is not gathered. A bag that can lay relatively flat in a drying oven takes less time for the sample to dry.

The foregoing needs and problems indicate that it would be a significant advance in the art if an ore sample bag can be constructed which can be opened and closed using a single reusable means for closure. It would reduce costs and be a further advance to provide a durable, reliable, and reusable ore sample bag that will maintain sample integrity so that a more accurate representative sample may be assayed.

It would also be a significant advance to provide a labeling system for identification and tracking of ore samples that is more reliable, more cost effective, and less likely to result in errors. A system that avoids redundancy and human error while providing labels that are both scannable and human readable would be particularly advantageous.

OBJECTS AND BRIEF SUMMARY OF THE INVENTION

In view of the foregoing needs and problems experienced in the collection, transportation, identification, tracking, and processing of ore samples, it is a primary object of the present invention to provide an ore sample bag that can be used for ore samples collected from either dry drilling or reverse circulation drilling that maintains sample integrity, is durable, reliable, and may be easily tracked.

It is another object of the present invention to provide an ore sample bag with closure means that can easily be opened and closed interchangeably.

A further object of the present invention is to provide an ore sample bag having identification and tracking indicia sewn into the seam of the bag in a manner that eliminates the need to manually write identification indicia on each bag.

Another object of the present invention is to provide an ore sample bag that is capable of resting relatively flat in a drying oven, thereby reducing drying time and costs.

The foregoing objects are accomplished by an ore sample bag of the present invention which utilizes folded seams to maintain sample integrity, means for closure of the bag that can be opened and closed interchangeably, and a wrap around bar code labeling system.

In one preferred embodiment of the present invention an ore sample bag comprises a folded seam and a drawstring with a slide-spring lock mechanism slidably disposed on the drawstring. The drawstring is slidably enclosed in the wall of and encircles the top opening of the ore sample bag. The material of the ore sample bag may be gathered to close the top opening of the ore sample bag by sliding the slide-spring lock mechanism over the drawstring. The ore sample bag may be opened by releasing the slide-spring lock mechanism and sliding it to permit the gathered material of the bag to slide over the drawstring.

In another embodiment of the present invention the ore sample bag utilizes a secure lock top without any drawstring. The bag has a folded bottom, a top opening, an obverse side, a reverse side, and a pair of side seams extending from the bottom to the top of the bag. Each seam is formed by folding together an edge of the obverse side and an edge of the reverse side of the bag. Each seam is secured along a path adjacent to the seam fold. The reverse side of the bag has a top flap extending beyond the top opening and the obverse side of the bag has a collar flap comprising a portion of the material of the obverse side folded over the obverse side towards the folded bottom of the bag. The collar flap is secured along each of the side seams.

With this embodiment, the bag can be closed by maneuvering the top portion of the bag into a secure folded closure and can be opened by unfolding the top portion of the bag. By folding the top flap into the top opening of the ore sample bag and then reversing the collar flap over the top opening of the ore sample bag by turning the collar flap inside out, the bag is closed.

One preferred method for reversing the collar flap is to position a user's thumbs beneath the collar flap with each thumb in the proximity of one of the side seams, and then reverse the collar flap by leveraging the user's thumbs to turn the collar flap inside out.

This bag configuration can be reopened by reversing the collar flap to its original disposition (in the same manner it was reversed inside out) and then extracting the top flap from the top opening.

This embodiment for the ore sample bag is particularly catcher friendly when used for mine sampling. The collar flap acts as an inverted pocket for receiving a portion of the catcher so that the bag hangs over the mouth of the catcher.

These and other objects and features of the present invention will become more fully apparent through the following description and appended claims taken in conjunction with the accompanying drawings.

BRIEF DESCRIPTION OF THE DRAWING

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Referring now specifically to the drawings, wherein like numerals indicate like parts throughout, an ore sample bag is provided which may be interchangeably opened and closed.

Figure 9:
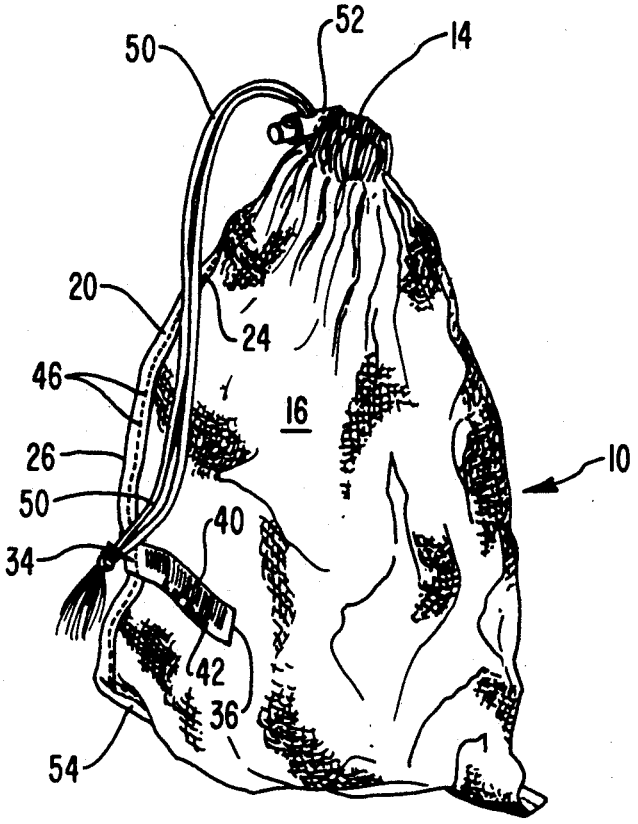
FIG. 9 is a perspective view of the obverse side of an alternative embodiment of the ore sample bag of the present invention showing a slide-spring lock mechanism securing the bag in a closed disposition and the front side of a wrap around bar coded label.
Figure 10:
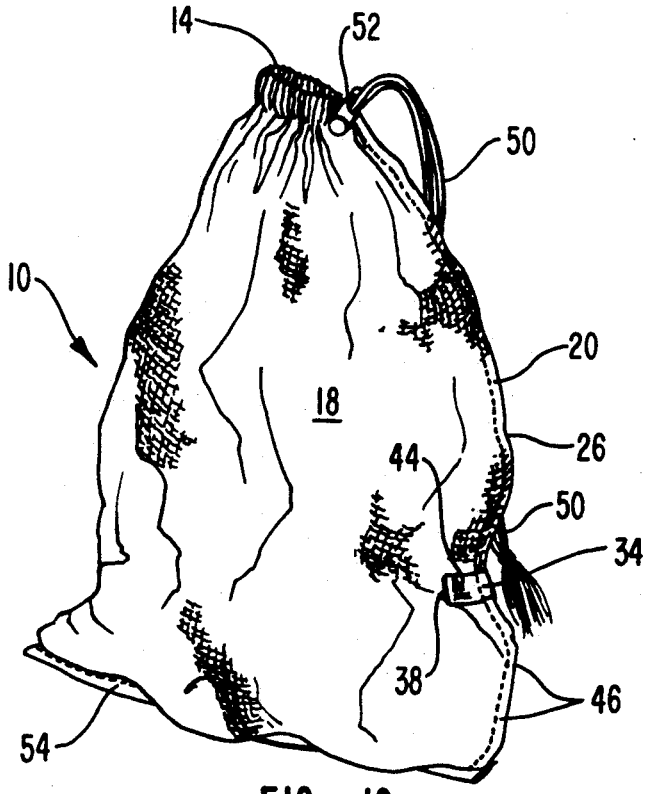
FIG. 10 is a perspective view of the reverse side of an alternative embodiment of the ore sample bag of the present invention showing a slide-spring lock mechanism securing the bag in a closed disposition and the back side of a wrap around bar coded label.

One preferred embodiment of the apparatus of the present invention is illustrated in FIGS. 1 through 8 and another preferred embodiment is illustrated in FIGS. 9 and 10 and both preferred embodiments comprise a bag, generally designated 10, which may be constructed from a flexible semipermeable sheet material. Although various flexible non-permeable or semipermeable materials may be used, it is preferred that Tyvek ® or a bone velour material having a 270 to 400 mesh be used. The bone velour material in the 270 to 400 mesh range has been found to be particularly suitable in that its canvas-like texture is durable and reliable in permitting drying of an ore sample while reducing loss of the fine particles of the ore sample through the pores in the bag 10.

Figure 1:
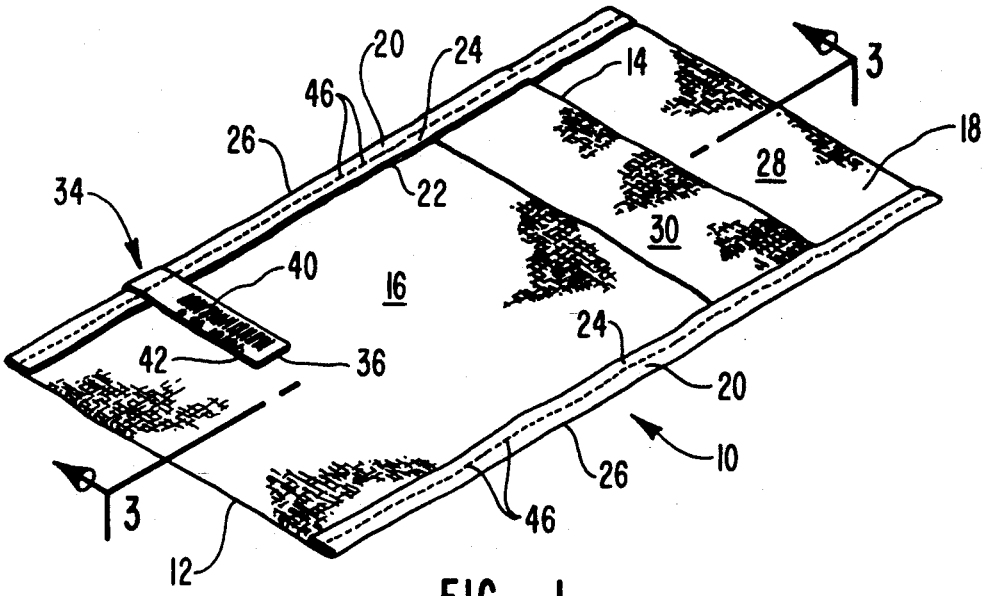
FIG. 1 is a perspective view of the obverse side of a preferred embodiment of the ore sample bag of the present invention showing the front portion of a wrap around bar coded label attached to the bag and the secure lock top in an open disposition.
Figure 2:
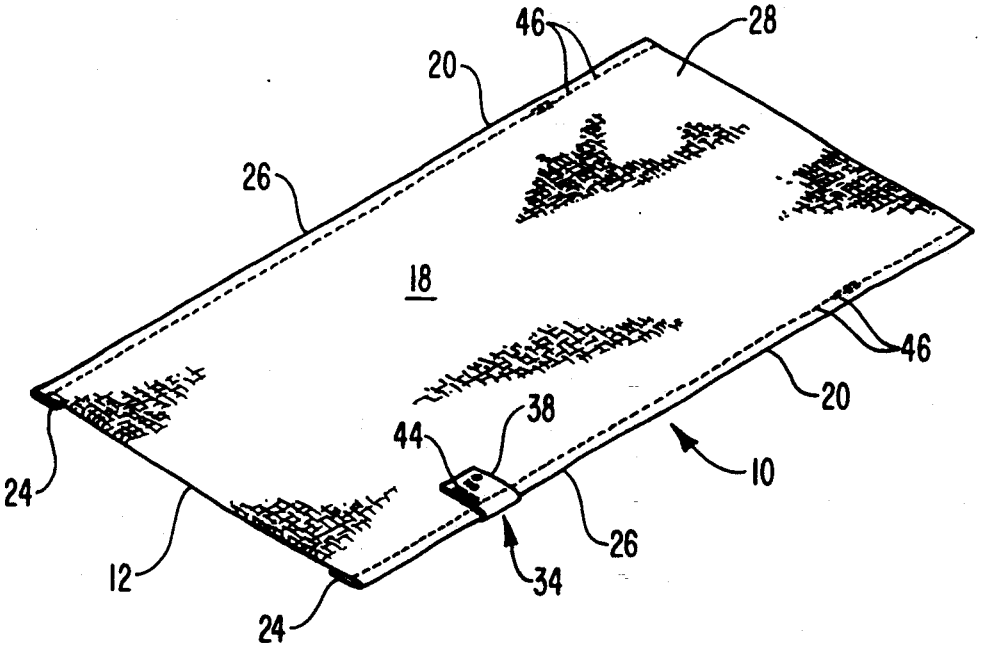
FIG. 2 is a perspective view of the reverse side of the ore sample bag of FIG. 1, showing the back portion of a wrap around bar coded label.
Figure 3:
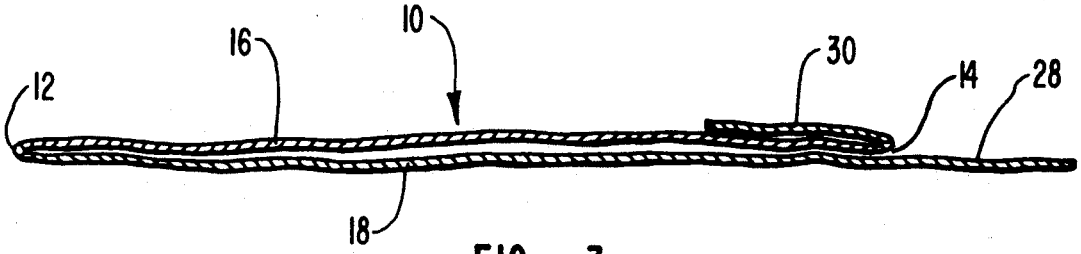
FIG. 3 is a sectional view of the ore sample bag taken along Line 3—3 of FIG. 1.

The bag 10 of the embodiment shown in FIGS. 1 and 2 has a folded bottom 12, a top opening 14, an obverse side 16, a reverse side 18, and a pair of folded seams 20. Each folded seam 20 extends the length of the reverse side 18 and comprises an edge 22 of the obverse side 16 and an edge 24 of the reverse side 18 folded together and secured along a path adjacent to the fold 26. The configuration of the bag 10 is such that a portion of the reverse side 18 extends beyond the top opening 14 to form a top flap 28, and a portion of the obverse side 16 is turned down (see FIG. 3) and secured along each folded seam 20 to form a collar flap 30, as best shown is FIGS. 1 and 4.

To form the folded seam 20, an edge 22 of the obverse side 16 is aligned with an edge 24 of the reverse side 18 and folded together towards the longitudinal axis of the obverse side (see line 3—3 of FIG. 1). The amount of the material folded over is only so much as is necessary to make an acceptable fold 26 which can be secured along a path adjacent to and slightly spaced from the fold 26, and so that fold 26 will not pull loose or the material will not unravel when an ore sample is placed in the bag 10. Although the folded seal 20 may be secured by any suitable means such as by adhesive stitching, stapling, or any combination thereof, it is preferred that the folded seam 20 is secured by stitching 46.

Figure 4:
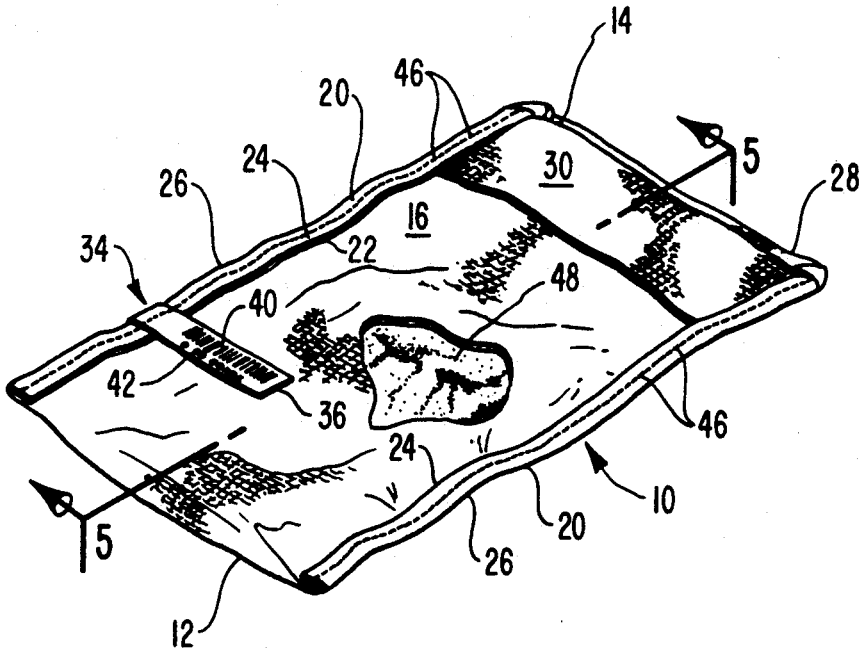
FIG. 4 is a perspective view of the ore sample bag shown in FIG. 1 with an ore sample disposed within the bag and shown by cut-away and the top flap folded into the bag as an illustration of the first: step taken in closing the bag.
Figure 5:
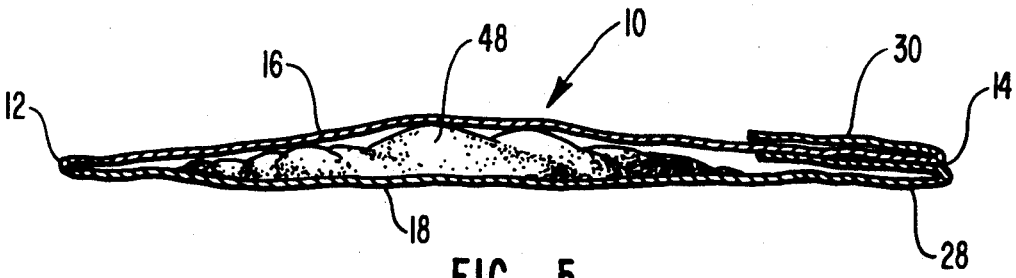
FIG. 5 is a sectional view of the ore sample bag along Line 5—5 of FIG. 4 showing the top flap folded into the bag and an ore sample disposed within the bag.
Figure 6:
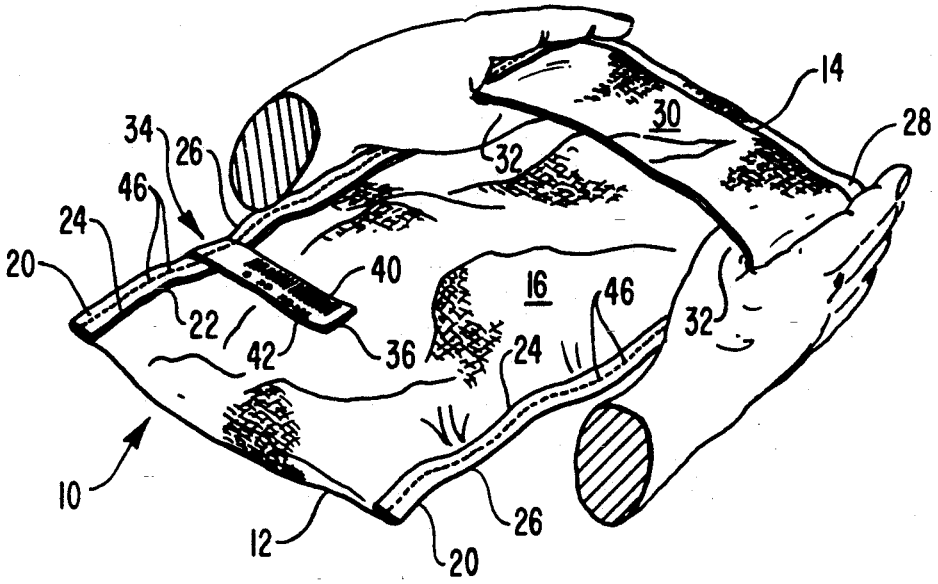
FIG. 6 is a perspective view of the ore sample bag as shown in FIG. 4 showing the disposition of a user's hands for conducting an additional step involved in closing the bag; namely, the placement of thumbs beneath the collar flap and adjacent the seams of the bag.
Figure 7:
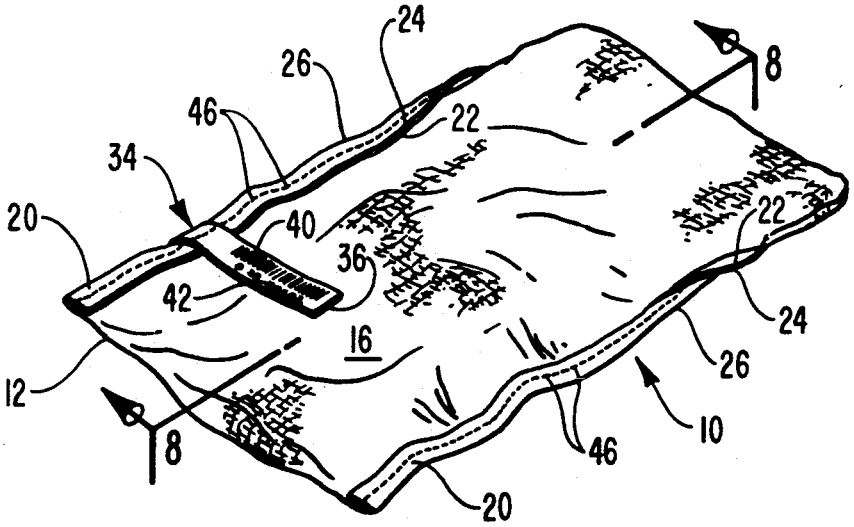
FIG. 7 is a perspective view of the ore sample bag after the collar flap has been reversed over the top of the bag to close the bag.
Figure 8:
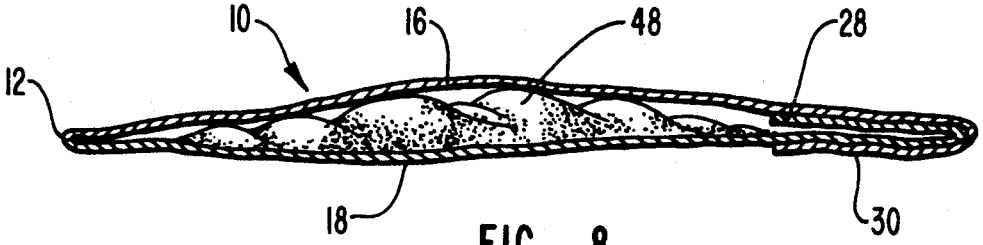
FIG. 8 is a sectional view of the ore sample bag along Line 8—8 of FIG. 7 showing the collar flap as turned inside out and reversed over to close the bag and an ore sample disposed within the bag.

The top flap 28 and collar flap 30 work together to provide a means for interchangeably opening and closing the bag 10. To close the bag 10, the top flap 28 is tucked into or folded into the top opening 14 of the bag 10 (as shown in FIGS. 4 and 5), and the collar flap 30 is reversed over the top opening 14 by turning the collar flap 30 inside out (see FIGS. 7 and 8). The reversal of the collar flap 30 is easily accomplished by positioning one's thumbs 32 beneath the collar flap 30, as shown in FIG. 6, with each in the proximity of one of the side folded seams 20 and then leveraging one's thumbs 32 to turn the collar flap 30 inside out. Of course, there are many ways in which the collar flap 30 may be turned inside out so that the top opening 14 is enclosed, however, the technique using one's thumbs 32 described above is preferred To reopen a closed bag 10, one need only reverse the inside out collar flap 30 to its original disposition, and extract the top flap 28 from its within the bag 10. The bag 10 can subsequently be closed again in the manner it was originally closed.

One of the most advantageous features of this secure lock top embodiment of the bag 10 is the bag 10 may be closed without bunching or gathering the top of the bag 10 so that the bag 10 lies relatively flat an ore sample 48 is contained therein. By lying relatively flat (see FIGS. 4 and 5), the contents of the bag 10 can dried more rapidly in an oven used for preparing the contents for assay. By reducing the drying time, the expense in processing ore samples 48 is reduced. Additionally, bags 10 with the secure lock top will travel on a conveyor without hanging up or snagging a tie or drawstring.

In order to identify and track ore samples 48, each bag 10 may be constructed with a label 34 with identification and tracking indicia. Although the 34 may be constructed of almost any durable material, it is preferred that the label 34 be made from a polyester stock an over laminate to protect the indicia on the label 34. It has been found that it is particularly advantageous to use a photo composed label 34 with a UV resistant over laminate. Also a preferred embodiment of the bag 10 of the invention utilizes a wrap around label 34 which is disposed over the folded seam 20 and secured to the bag 10 such that a front portion 36 of the label 34 is disposed adjacent the obverse side 16 of the bag 10 and a back portion 38 of the 34 is disposed adjacent the reverse side 18 of the bag 10. The label 34 bears indicia on both the front portion 36 and the back portion 38. The indicia on the front portion 36 a machine readable bar code 40 and human readable indicia 42 while the indicia on the back portion 38 is a human readable notation 44 and corresponds to the indicia on the portion 36.

The bar coding allows for of ore samples 48 in random order by merely scanning the bar code 40 using a hand-held or fixed scanner. Additionally, ore samples 48 can be logged in at any point during collection, transportation, and preparation of the sample for assay. By attaching the label 34 in the wrap around fashion as described above and as shown in FIGS. 1–2, 4, 6–7, and 8–9 the reliability of the identification and tracking of ore samples 48 is significantly increased. For example, if the front portion 36 of the label 34 were damaged or torn from the bag 10 so that the indicia on the front portion 36 could not be read by machine or man, the back portion 38 of the label 34 enables the user to identify the sample and manually track its progress through processing and assay. Similarly, if the back 38 of the label 34 is damaged or destroyed, the indicia on the front portion of the label 34 may be available for identification and tracking. Further, handling of the ore sample bags 10 is reduced because the user heed not turn over a bag 10 for identification or tracking purposes. Human readable indicia 42 sufficient for a user to identify a bag 10 is available on the front portion 36 of the label and human readable notation 44 corresponding to the human readable indicia 42 is available on the back portion 38 of the label 34. This label 34 configuration eliminates the need to write identifying indicia on the bag 10 which saves a tremendous amount of time, and renders the present three tag technique for identification and tracking obsolete. Moreover, if the bar code 40, human readable indicia 42, and human readable notation 44 are computer generated and placed on the label 34 by the computer, the bar code 40 is more reliably scannable, using an optical or other scanner, and redundancies and missing numbers are virtually eliminated.

To construct a bag 10 with the secure lock top as shown in FIGS. 1 through 8, an elongated, substantially rectangular flexible material is folded to define the obverse side 16, the reverse side 18, and the folded bottom 12. Each side edge 22 of the obverse side 16 is aligned to the corresponding side edge 24 of the reverse side 18. A portion of the obverse side 16 is folded or turned back towards the folded bottom 12 so that the side edges 22 of the portion of the obverse side 16 align to form the collar flap 30 and a portion of the reverse side 18 extends beyond the top opening 14 to form the top flap 28. One folded seam 20 is formed by folding the aligned side edges 22, 24 of one side of the obverse side 16 and the reverse side 18 together towards the longitudinal center of the obverse side 16. The folded seam 20 extends the length of the reverse side 18, as shown in FIG. 1. The folded seam 20 is secured along a path adjacent to the fold of the folded seam by any suitable means, but preferably by stitching. The other folded seam 20 is formed by folding the other aligned side edges 22, 24 of the other side of the obverse side 16 and the reverse side 18 together towards the longitudinal center of the obverse side 16 so that the folded sea 20 extends the length of the reverse side 18. This folded seam 20 may be secured in the same manner as the first folded seam 20. As so constructed, the folded seam 20 assists in maintaining the integrity of the ore sample 48 within the bag 10 because it virtually eliminates leakage of particles from the ore sample 48 through the seam.

FIGS. 9 and 10 illustrate another preferred embodiment of the present invention wherein the ore sample bag 10 comprises a single folded seam 20 along the side of the bag 10 and a drawstring 50 with a slide-spring lock mechanism 52 slidably disposed on the drawstring 50. The bag 10 of the embodiment shown also has a folded seam bottom 54. The drawstring 50 is slidably enclosed in the wall of and encircles the top opening 14 of the ore sample bag 10. The material of the ore sample bag 10 may be gathered to close the top opening 14, shown in FIGS. 9 and 10, by sliding the slide-spring lock mechanism 52 over the drawstring 50. The ore sample bag 10 may be opened by releasing the slide-spring lock mechanism 52 and sliding it to permit the gathered material of the bag 10 to slide over the drawstring 50.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An apparatus for handling ore samples comprising:

A bag constructed from a flexible semipermeable sheet material, said material being in the range of from 270 mesh to 400 mesh, said bag being folded to have a top opening, an obverse side, a reverse side, and at least one folded seam, said folded seam comprising an edge of said obverse side and an edge of said reverse side folded together and secured along a path adjacent to such fold;

means for interchangeably opening and closing said bag; and a label disposed over said folded seam and secured to said bag such that a front portion of said label is disposed adjacent said obverse side of said bag and a back portion of said label is disposed adjacent said reverse side of said bag, said label bearing indicia on the front portion and on the back portion wherein the indicia on the front portion comprises a machine readable bar code and human readable indicia and the indicia on the back portion is human readable and corresponds to the indicia on the front portion.

2. An apparatus for handling ore samples as set forth in claim 1, wherein said bag has a folded bottom, said top opening, and a pair of side folded seams extending from the bottom to the top of said bag and said means for interchangeably opening and closing said bag comprises a configuration of said bag such that said reverse side of said bag has a top flap extending beyond said top opening and said obverse side of said bag has a collar flap comprising a portion of the material of said obverse side folded over said obverse side and secured along each of said side folded seams.

3. An apparatus for handling ore samples as set forth in claim 1, wherein said means for interchangeably opening and closing said bag comprises a drawstring and a slide-spring lock mechanism in sliding engagement with said drawstring, said slide-spring lock mechanism being capable of releasable locking engagement along said drawstring and the disposition of said slide-spring lock mechanism along said drawstring determines the closure of said bag and the degree to which said bag is opened.

4. An apparatus for handling ore samples as set forth in claim 1, wherein said material from which said bag is constructed is a bone velour.

5. An apparatus for handling ore samples as set forth in claim 1, wherein said material from which said bag is constructed is Tyvek ®.

6. An apparatus for handling ore samples as set forth in claim 1, wherein said label is constructed from a polyester stock and further comprises a protective over laminate.

7. An apparatus for handling ore samples as set forth in claim 1, wherein the indicia on said label is computer generated.

8. An apparatus for handling ore samples as set forth in claim 1, wherein the bar coded indicia on said label is optically scannable.

* * * * *